US012696923B2

(12) United States Patent
Allen

(10) Patent No.: US 12,696,923 B2
(45) Date of Patent: Aug. 4, 2026

(54) LAMINATE FOR A WRAPPED BUNDLE OF TOBACCO INDUSTRY PRODUCTS

(71) Applicant: British American Tobacco (Investments) Limited, London (GB)

(72) Inventor: Thomas Robert Allen, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 883 days.

(21) Appl. No.: 17/297,155

(22) PCT Filed: Dec. 11, 2019

(86) PCT No.: PCT/GB2019/053500
§ 371 (c)(1),
(2) Date: May 26, 2021

(87) PCT Pub. No.: WO2020/141296
PCT Pub. Date: Jul. 9, 2020

(65) Prior Publication Data

US 2022/0015409 A1 Jan. 20, 2022

(30) Foreign Application Priority Data

Dec. 31, 2018 (GB) ..... 1821303

(51) Int. Cl.
*A24C 5/01* (2020.01)
*A24B 3/14* (2006.01)
(Continued)

(52) U.S. Cl.
CPC ..... *A24C 5/01* (2020.01); *A24B 3/14* (2013.01); *A24C 5/1807* (2013.01);
(Continued)

(58) Field of Classification Search
CPC ..... A24C 5/01; A24C 5/1807; A24C 5/1857; A24B 3/14; B65D 65/40; B65D 77/02;
(Continued)

(56) References Cited

U.S. PATENT DOCUMENTS 5,711,476 A 1/1998 Fujimoto
2003/0230504 A1 12/2003 Hamming
(Continued)

FOREIGN PATENT DOCUMENTS

EP 3871997 A1 9/2021
GB 2503738 A 1/2014
(Continued)

OTHER PUBLICATIONS

International Search Report for corresponding application PCT/GB2019/053500 filed Dec. 11, 2019; Mail date Apr. 17, 2020.
(Continued)

*Primary Examiner* — Megha M Gaitonde
(74) *Attorney, Agent, or Firm* — CANTOR COLBURN LLP

(57) ABSTRACT

A laminate for a wrapped bundle of tobacco industry products is disclosed. The laminate comprises an outer layer (3) having a first cut (5) that defines an outer layer region bounded by said first cut, and an inner layer (4) having a second cut (6) that defines an inner layer region bounded by said second cut. The inner layer region lies within the outer layer region. The outer layer region comprises a tab (17) having a remote edge, the tab being for lifting the outer layer region to cause the inner and outer layers to delaminate in a peripheral region between the first and second cuts (5,6) to create an opening in the laminate. The laminate is configured such that said remote edge is exposed. A wrapped bundle (22) of tobacco industry products, and a pack (27), comprising the laminate is also disclosed, together with a method
(Continued)

of manufacturing a laminate for a wrapped bundle of tobacco industry products.

19 Claims, 10 Drawing Sheets

(51) Int. Cl.
*A24C 5/18* (2006.01)
*B65D 65/40* (2006.01)
*B65D 77/02* (2006.01)
*B65D 81/38* (2006.01)

(52) U.S. Cl.
CPC ..... *A24C 5/1857* (2013.01); *B65D 65/40* (2013.01); *B65D 77/02* (2013.01); *B65D 81/3897* (2013.01); *B65D 2577/2025* (2013.01)

(58) Field of Classification Search
CPC ..... B65D 81/3897; B65D 2577/2025; B65D 2575/586; B65D 85/1045; Y10T 428/24273; Y10T 428/24298; Y10T 428/24314; Y10T 428/24322; Y10T 428/24479; Y10T 428/24612; Y10T 428/24802; Y10T 428/24917; Y10T 428/24942; Y10T 428/2495
USPC ..... 428/131, 136, 134, 137, 138, 156, 172, 428/195.1, 209, 212, 213
See application file for complete search history.

(56) References Cited

U.S. PATENT DOCUMENTS

2011/0303567 A1* 12/2011 Bray ..... B65D 85/1045 206/265
2017/0334634 A1* 11/2017 Bray ..... B65B 51/02

FOREIGN PATENT DOCUMENTS

| | | | | | |
|---|---|---|---|---|---|
| GB | 2538267 | A | * | 11/2016 | ..... A24F 23/02 |
| WO | 2011009520 | A1 | | 1/2011 | |
| WO | 2016087819 | A1 | | 6/2016 | |
| WO | WO-2016087830 | A1 | * | 6/2016 | ..... B65D 85/10568 |
| WO | 2016203024 | A1 | | 12/2016 | |
| WO | 2017060736 | A1 | | 4/2017 | |

OTHER PUBLICATIONS

Written Opinion of the International Searching Authority for corresponding application PCT/GB2019/053500 filed Dec. 11, 2019; Mail date Apr. 17, 2020.
Russian Office Action for corresponding application 2021119024; Dated Dec. 24, 2021.

* cited by examiner

LAMINATE FOR A WRAPPED BUNDLE OF TOBACCO INDUSTRY PRODUCTS

FIELD

The present invention relates to a laminate for a wrapped bundle of tobacco industry products, for example a wrapped bundle of cigarettes.

BACKGROUND

Cigarettes packaging comprises a carton made from cardboard which has a base and a hinged lid. The base contains a wrapped bundle of cigarettes that are wrapped in a laminate that has an extraction opening to facilitate removal of the cigarettes from the pack when the lid is open. The laminate includes score lines that define an integral opening flap. A score line in an inner layer of the laminate can be offset from a score line in an outer layer of the laminate to provide a peripheral region. The peripheral region can have a pressure sensitive adhesive so that the opening flap can be resealed over the opening after first use.

SUMMARY

In accordance with embodiments of the invention, there is provided a laminate for a wrapped bundle of tobacco industry products, the laminate comprising an outer layer having a first cut that defines an outer layer region bounded by said first cut, and an inner layer having a second cut that defines an inner layer region bounded by said second cut, the inner layer region lying within the outer layer region, wherein the outer layer region comprises a tab for lifting the outer layer region to cause the inner and outer layers to delaminate in a peripheral region between the first and second cuts to create an opening in the laminate, said tab comprising a remote edge, and wherein the laminate is configured such that said remote edge is exposed.

In some examples, the entire edge of the tab is exposed.

The laminate may comprise a recess. The recess may be partially bounded by the remote edge of the tab.

The recess may be formed in said outer layer. The recess may, additionally, be partially bounded by an opposing edge of said outer layer that faces the remote edge of the tab/

Preferably, the remote edge of the tab and opposing edge of the outer layer are spaced from each other.

The recess may extend through the entire thickness of the outer layer. Alternatively, the recess may extend only partially through the thickness of the outer layer.

In some embodiments, the opposing edge of the outer layer and the remote edge of the tab are parallel. In some other examples, the opposing edge of the outer layer is angled relative to the remote edge of the tab.

The outer layer may comprise a line of weakness defining an edge of the tab. The tab may be folded about the line of weakness.

The laminate may further comprise an adhesive-free region between the outer layer and inner layer of the laminate, the adhesive-free region being coincident with the tab. The adhesive-free region may cover the recess.

In examples, at least the peripheral region of the laminate may comprise a pressure-sensitive adhesive between the inner layer and the outer layer such that the outer layer can be re-adhered to the inner layer in the peripheral region. Moreover, the inner layer region and the outer layer region may be attached to each other using a permanent adhesive.

In some examples, the laminate comprises a third layer, disposed between the inner layer and the outer layer, and either the first cut or the second cut may extend through the third layer.

In examples where the first cut extends through the third layer, the recess may extend through the first layer and at least partially through the third layer. Alternatively, the recess may extend entirely through the third layer.

The inner layer and/or the outer layer may comprise polyethylene terephthalate. The first cut and the second cut may be formed by laser cutting. The recess may be formed by laser ablation.

According to a further aspect of the present invention, there is provided a wrapped bundle of tobacco industry products, the wrapped bundle comprising the laminate of described above, the laminate being wrapped about a group of tobacco industry products.

According to a further aspect of the present invention, there is provided a pack of tobacco industry products, the pack comprising the wrapped bundle.

According to a further aspect of the present invention, there is provided a method of manufacturing a laminate for a wrapped bundle of tobacco industry products, the laminate comprising an outer layer and an inner layer, the method comprising:

forming a first cut in the outer layer to define an outer layer region, the outer layer region including a tab having a remote edge, forming a second cut in the inner layer to define an inner layer region, the inner layer region lying within the outer layer region such that lifting the tab causes the inner layer and the outer layer to delaminate in a peripheral region between the first and second cuts to create an opening in the laminate, and wherein the method further comprises exposing said remote edge of the tab.

The method may comprise forming a recess in the outer layer of the laminate such that said recess is partially bounded by said remote edge of the tab.

The method may comprise forming the recess such that said recess is additionally partially bounded by an opposing edge of said outer layer that faces the remote edge of the tab, and such that said remote edge and opposing edge are spaced from each other.

The first cut and second cut may be formed by laser cutting. The recess may be formed by laser ablation.

The opposing edge of the recess may be angled relative to the remote edge of the tab.

The recess may be formed by laser ablation, which may include scanning the laser across the area of the recess, and wherein the power of the laser is varied to create the angled side of the recess.

The method may further comprise directing an air jet into the recess to lift the tab. The method may further comprise forming a line of weakness defining an edge of the tab. The method may comprise folding the tab.

In some examples, the first cut is formed in the outer layer, and the second cut is formed in the inner layer, before the outer layer and the inner layer are combined to form a laminate. In other examples, the inner layer and the outer layer are combined to form a laminate and then the first and second cuts are formed.

BRIEF DESCRIPTION OF THE DRAWINGS

Embodiments of the invention will now be described, by way of example only, with reference to the accompanying drawings, in which.

DETAILED DESCRIPTION

Figure 1:
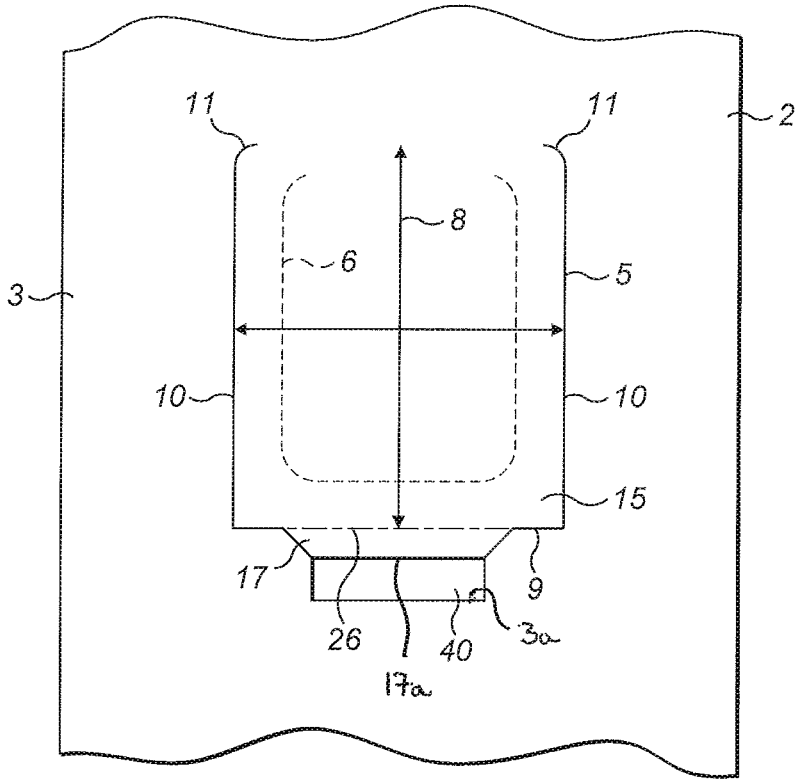
FIG. 1 shows an outer view laminate for a wrapped bundle of tobacco industry products, including an integral opening.

The various examples of laminates described hereinafter are for forming a wrapped bundle of tobacco industry products by wrapping the laminate around a group of tobacco industry products, such as cigarettes. The laminates have a series of cuts to enable an opening to be formed in the wrapped bundle for extracting cigarettes from the wrapped bundle. The cuts further define a cover flap, which is integrally formed from one or more of the layers of the laminate and can be used to re-cover the opening that is formed. The wrapped bundle can be received in a hinged-lid pack.

Forming the opening and the cover flap from cuts made in the laminate obviates the need to provide a separate label to cover the opening. This simplifies the manufacturing process because a further step of applying a separate label is not needed. Moreover, as there is no separate label other than the label formed from a part of the laminate itself, there are no problems associated with alignment of a separate label to other features of the packaging. The lack of additional label also reduces the amount of material required for the packaging, which can reduce the cost and environmental impact.

As described in more detail with reference to FIGS. 4 to 6, the laminate 2 for forming the wrapped bundle has two or more layers. In the embodiments described herein the laminate 2 has an inner layer 4 and an outer layer 3 such that, when the laminate 2 is wrapped about a group of cigarettes, the outer layer 3 is disposed on the outside of the wrapped bundle facing away from the cigarettes, and the inner layer 4 is on the inside of the wrapped bundle facing toward the cigarettes. The inner layer 4 is adhered, over at least a part of its surface area, to the outer layer 3 to form the laminate 2.

The laminate 2 is provided with a first cut 5 in the outer layer 3 and a second cut 6 in the inner layer 4. The first and second cuts 5, 6 shown in the accompanying drawings are either shown as a solid line, if the cut is in the layer of the laminate 2 on the side illustrated, or as a dotted line, if the cut is in the layer of the laminate 2 on the opposite side to that illustrated.

Figure 2:
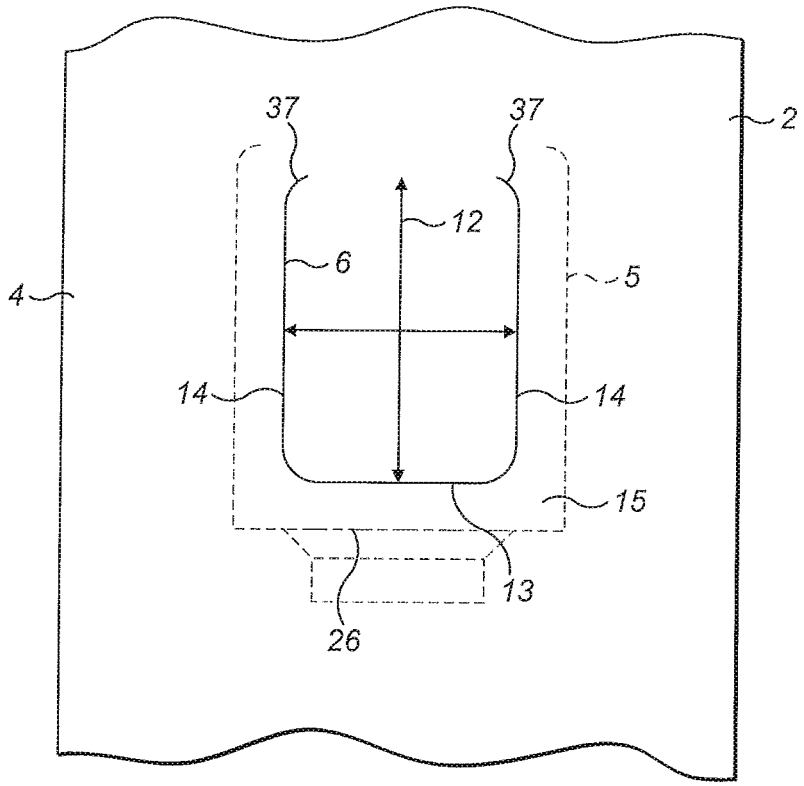
FIG. 2 shows an inner view of the laminate of FIG. 1.

FIG. 1 shows a laminate 2 from the side of the outer layer 3. FIG. 2 shows the same laminate 2 from the side of the inner layer 4.

Referring to FIGS. 1 and 2, a first cut 5 is made in the outer layer 3 of the laminate 2. The first cut 5 extends through or substantially through the outer layer 3 of the laminate 2. The first cut 5 does not extend into the inner layer 4 of the laminate 2.

The first cut 5 in the laminate 2 delimits a first region 8 in the outer layer 3, as indicated in FIG. 1. The first cut 5 has a bottom edge 9, opposing side edges 10 and a partial top edge 11 that extends from the opposing side edges 10. Therefore, the first region 8 of the outer layer 3 remains attached to the remainder of the outer layer 3 of the laminate 2 across the top edge 11, which acts as a hinge when the wrapper 1 is opened as described hereinafter.

A second cut 6 is made in the inner layer 4 of the laminate 2. The second cut 6 extends through or substantially through the inner layer 4 of the laminate 2. The second cut 6 does not extend into the outer layer 3 of the laminate 2.

The second cut 6 in the laminate 2 delimits a second region 12 in the inner layer 4, as indicated in FIG. 2. The second cut 6 has a bottom edge 13 and opposing side edges 14 that are parallel to and offset from the bottom edge 9 and opposing side edges 10 of the first cut 5, respectively. The second cut also comprises rounded ends 37 at the ends of the opposing side edges 14. The rounded ends 37 are proximate to the partial top edge 11 of the first cut 5.

The second cut 6 is offset relative to the first cut 5, such that the second cut 6 is disposed entirely within a boundary defined by the first cut 5. Therefore, the second region 12 is smaller than, and disposed within, the first region 8. That is, the edges 13, 14 of the second cut 6 are inwardly offset from the edges 9, 10, 11 of the first cut 5 so that the cuts 5, 6 formed within the laminate 2 are spaced from each other to define a peripheral region 15 between the first and second cuts 5, 6.

As with the first region 8 of the outer layer 3 of the laminate 2, the second region 12 of the inner layer 4 remains attached to the remainder of the inner layer 4 of the laminate 2 across a top edge, which is in line with the rounded ends 37 of the second cut 6.

A bottom part of the outer layer region 8, defined by the first cut 5, forms a tab 17. The tab 17 is defined by a part of the bottom edge 9 of the first cut 5.

Figure 3:
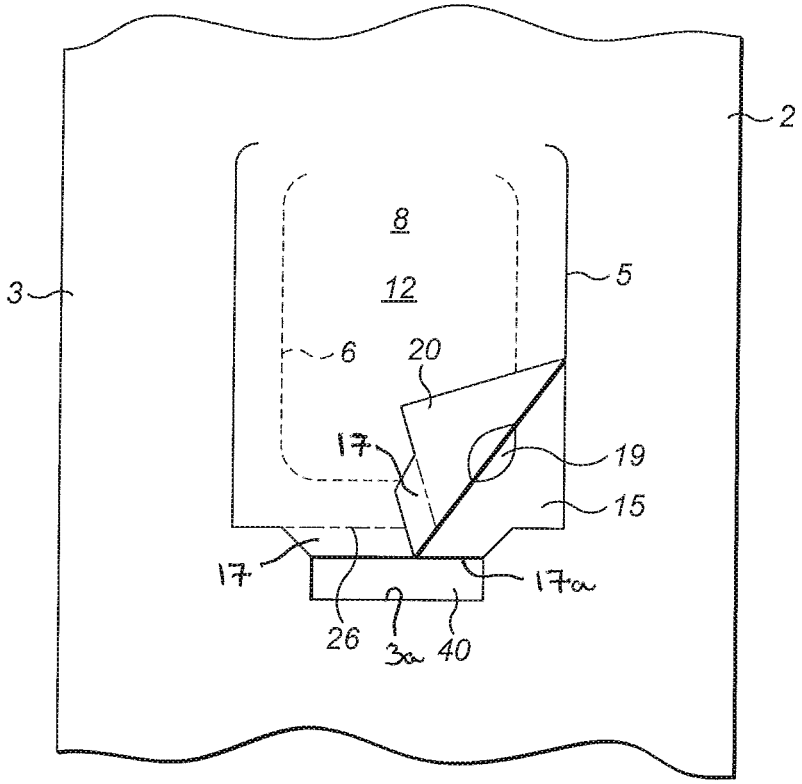
FIG. 3 shows an outer view of the laminate of FIGS. 1 and 2, with the integral opening partially opened.

FIG. 3 shows the laminate 2 of FIGS. 1 and 2 from the side of the outer layer 3. As shown, when the first and second regions 8, 12 of the laminate 2 are lifted they separate from the remainder of the laminate 2 along the first and second cut lines 5, 6. In this way, the first and second regions 8, 12 of the laminate 2 are lifted away from the remainder of the laminate 2 to form a cover flap 20 and an opening 19.

The first and second regions 8, 12 are adhered to each other in the region of the cover flap 20. Where the first and second areas 8, 12 overlap, i.e. within the second region 12, the inner and outer layers 3, 4 remain attached due to the bond between them. In the peripheral region 15, between the first and second cuts 5, 6, the inner and outer layers 3, 4 of the laminate 2 delaminate or become separated.

Therefore, the boundary of the opening 19 that is created in the laminate 2 when the first and second regions 8, 12 are lifted is defined by the second cut 6.

When opened, the first and second regions 8, 12 of the laminate 2 form a cover flap 20 that can be repositioned to close the opening 19.

In the present example, pressure-sensitive or 're-stick' adhesive is provided between the inner and outer layers 3, 4 of the laminate 2. Therefore, when the cover flap 20 is repositioned over the opening 19 the inner and outer layers 3, 4 will reattach in the peripheral region 15, where delamination had occurred.

Preferably, the pressure sensitive adhesive is provided to the outer layer 3, so that on opening the pressure sensitive adhesive remains on the outer layer 3 and not on the inner layer 4, and is not split between the outer and inner layers 3, 4. In this way, the pressure sensitive adhesive remains on the cover flap 20 and the peripheral region of the inner layer 4, which extends around the opening 19, is substantially adhesive free.

In other examples, a single-use, but releasable, adhesive may be provided between the inner and outer layers 3, 4 of the laminate 2. In this way, when closed, the cover flap 20 will still be repositioned over the opening 19 but will not be re-adhered to the laminate 2.

The above-described combination of offset first and second cuts 5, 6 in different layers of the laminate 2 provide a labyrinth seal through which fluids, such as air or other gasses, or liquids, or vapours are prevented, or substantially prevented, from passing. That is, a fluid would have to pass through one of the first or second cuts 5, 6, then between the layers 3, 4 of the laminate 2, through the adhesive provided in that region, and then through the other cut 5, 6. This arrangement therefore ensures that the wrapper 1 provides an effective barrier both prior to first opening and after re-closing.

In each of the above described embodiments, the tab 17 may optionally be provided with a fold line 26, as indicated in FIG. 1. The fold line 26 as illustrated is a dotted line because the fold line 26 is a line of weakening, not a cut line, as explained below.

The tab 17 may be separated from the remainder of the first region 8 by a fold line 26. The fold line 26 may comprise a score line, a line of perforations, or other weakening that provides a line along which the outer layer 3 can more readily flex relative to the remainder of the laminate 2. However, it will be appreciated that the laminate 2 itself is a flexible material, so the fold line 26 is an optional feature that would help control where the laminate 2 flexes.

The tab 17 is provided for a user to grip and to pull, which lifts the cover flap 20 to expose the opening 19. In this way, the contents of the wrapped bundle can be retrieved.

As shown in FIGS. 1 to 3, the laminate 2 further comprises a recess or pocket 40 that is formed in at least the outer layer 3 of the laminate 3. The recess 40 is located adjacent to the tab 17, one edge of the recess 40 being defined by a distal edge 17*a* of the tab 17. The recess 40 comprises a region where material has been removed from the laminate 2, in particular at least a portion of the outer layer 3 has been removed which is wider than any material removed simply as a result of forming the first cut 5. The recess 40 merges with the first cut 5 on the distal edge 17*a* of the tab 17, as illustrated. The distal edge 17*a* of the tab 17 is the remote edge of the tab 17 furthest from the remainder of the cover flap 20. The recess 40 is provided to make it easier for a user to initially lift and grip the tab 17, as it enables a user to insert their finger, thumb or at least a fingernail at least partially into the recess 40 in order to catch or lift the distal edge 17*a* of the tab 17, which is now exposed, or which is at least substantially more exposed than it would be simply as a result of forming the first cut 5 between the distal edge 17*a* of the tab 17 and the outer layer 3. In particular, it will be appreciated that there is a gap or space between the distal edge of the tab 17 and an opposing edge 3*a* of the outer layer 3 which is much wider than that formed simply by providing the first cut 5, to facilitate insertion of a finger or fingernail in order to engage with the distal edge 17*a* of the tab 17. In some embodiments, the width of the recess 40, i.e. the distance between the distal edge 17*a* of the tab 17 and the opposing edge 3*a* of the outer layer 3, is such that a portion of the inner layer 4 of the laminate is revealed and is visible to a user. It will also be appreciated that the length of the tab, i.e. in a direction extending parallel to the bottom edge 9 of the laminate 2, may be the same as the full width of the tab 17, but could also extend further, or less, than the length of the tab 17.

Figure 4:
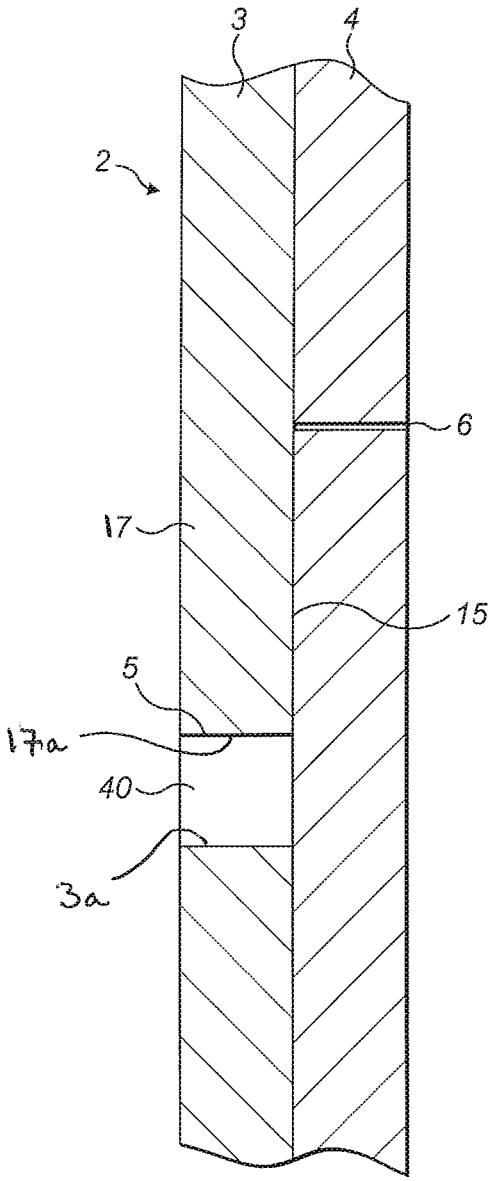
FIG. 4 shows a cross-section of a first example of the laminate.
Figure 5:
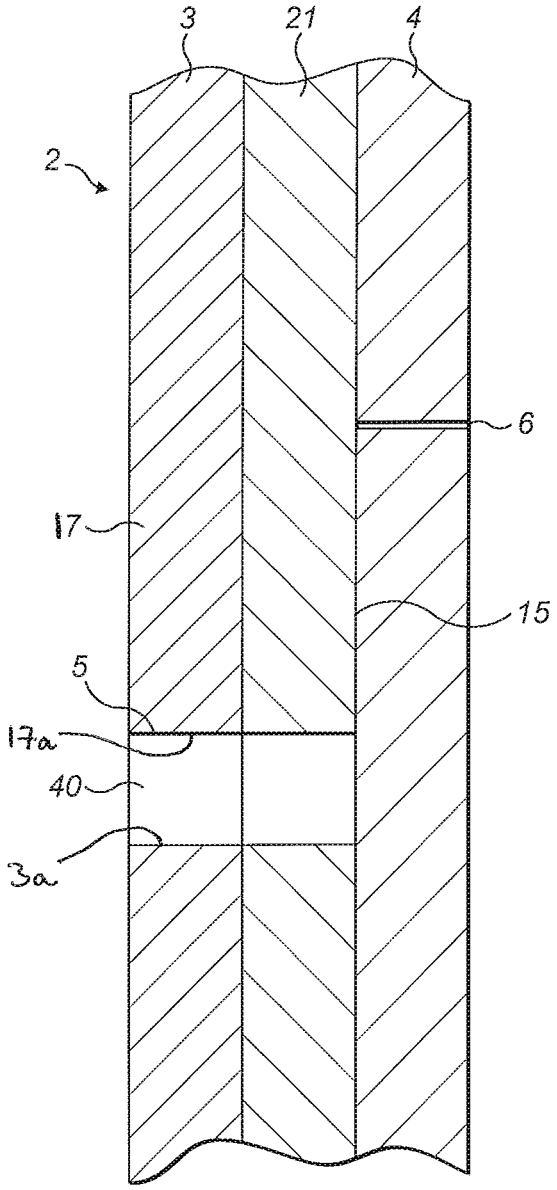
FIG. 5 shows a cross-section of another example of the laminate.
Figure 6:
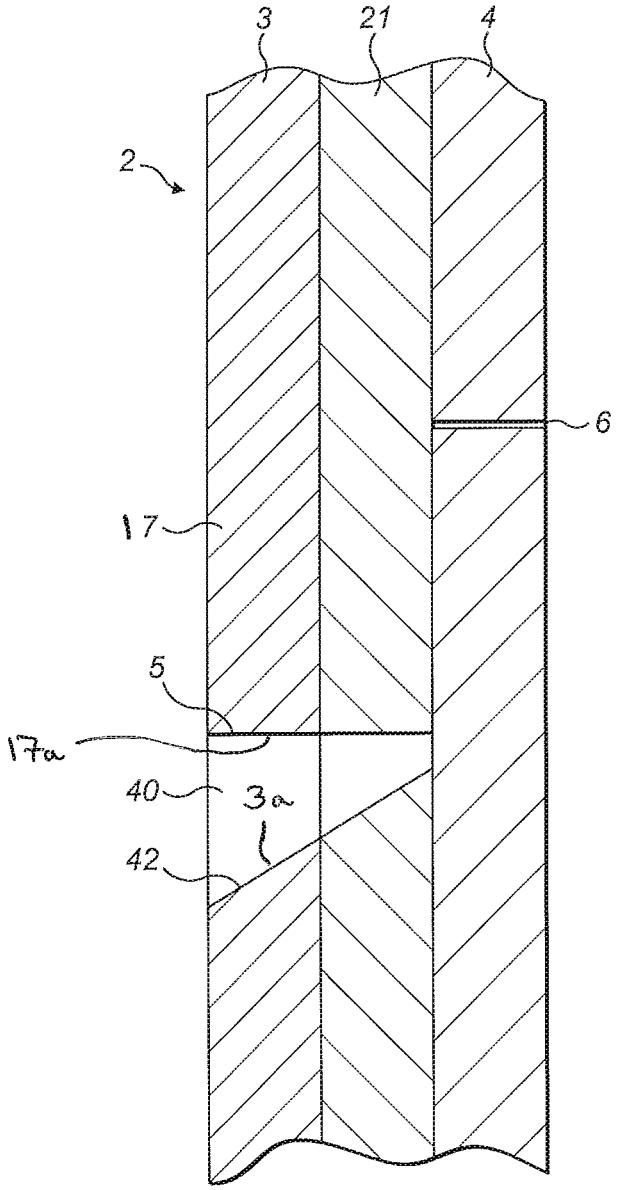
FIG. 6 shows a cross-section of another example of the laminate.

FIGS. 4, 5 and 6 show partial cross-sections of the laminates 2 described with reference to FIGS. 1 to 3 above, but which have different structures. Each of FIGS. 4, 5 and 6 are cross-sections of the laminate 2 through the tab 17 and recess 40.

FIG. 4 shows a cross-section of a laminate 2 having two layers, as specifically described with reference to the examples of FIGS. 1 to 3. That is, the laminate 2 has an outer layer 3 which is bonded (laminated) to an inner layer 4.

A first cut 5 is provided in the outer layer 3, and a second cut 6 is provided in the inner 1*o* layer 4, the first and second cuts 5, 6 are offset as previously described. As also shown in FIG. 4, the recess 40 is formed by removing an area of the outer layer 3 adjacent to the first cut 5. In this example, the recess 40 extends through the entirety of the outer layer 3, but it will be appreciated that the recess 40 may extend only partially through the outer layer 3.

In the cross-section shown in FIG. 4, the recess 40 and first cut 5 form one region, but it will be appreciated that this is only the case adjacent to the distal side of the tab 17, as shown in FIG. 1. In other parts of the first cut 5, away from the recess 40, the first cut 5 has its usual width.

As indicated in FIG. 4, the previously described peripheral region 15, between the inner and outer layers 3, 4, is defined between the first and second cuts 5, 6.

As shown, the arrangement of the offset first and second cuts 5, 6 provides a labyrinth barrier through which a substance would have to travel in order to enter or leave a wrapped bundle formed using the laminate 2.

FIG. 5 shows an alternative example of a laminate 2 with an outer layer 3, an inner layer 4, and a third layer 21. The third layer 21 is disposed between the inner and outer layers 3, 4, and the inner and outer layers 3, 4 are bonded (laminated) to opposing sides of the third layer 21.

As also shown in FIG. 5, the recess 40 is formed by removing an area of the outer layer 3 and the third layer 21 adjacent to the first cut 5. In this example, the recess 40 extends through the entirety of the outer layer 3 and the third layer 21, but it will be appreciated that the recess 40 may extend only through the outer layer 3, or partially through the outer layer 3, or partially through the third layer 21.

In the cross-section shown in FIG. 4, the recess 40 and first cut 5 form one region, but it will be appreciated that this is only the case adjacent to the distal side of the tab 17, as shown in FIG. 1. In other parts of the first cut 5, away from the recess 40, the first cut 5 has its usual width.

In the illustrated example, the outer layer 3 and the third layer 21 are bonded using a pressure-sensitive 're-stick' adhesive, and the inner layer 4 and the third layer 31 are bonded using a permanent adhesive. The first cut 5 is provided in the outer layer 3, and the second cut 6 is provided in both the inner layer 4 and in the third layer 21. The first and second cuts 5, 6 are offset as previously described.

As indicated in FIG. 5, in this example the peripheral region 15 between the first and second cuts 5, 6 is formed between the outer layer 3 and the third layer 21. It will be appreciated that in this example the inner and outer layers 3, 4 in the peripheral region 15 will be reattached to each other on closing the cover flap 20, although in this case the third layer 21 is disposed in between such that the outer layer 3 is attached directly to the third layer 21 and therefore indirectly to the inner layer 4.

In an alternative example similar to that of FIG. 5, the outer layer 3 and the third layer 21 are permanently bonded together, and the inner layer 4 and the third layer 21 are bonded together using pressure-sensitive adhesive. In this case, the first cut 5 is provided in the outer layer 3 and in the third layer 21, and the second cut 6 is provided in the inner layer 4 only. The first and second cuts 5, 6 are offset as previously described. In this example, the recess 40 would extend only through the outer layer 3, or only partially through the outer layer 3.

FIG. 6 shows a cross-section of a further example of a laminate 2. In this example, the laminate 2 has an outer layer 3, an inner layer 4 and a third layer 21, similar to the example of FIG. 5. In the example of FIG. 6 the recess 40 has an angled side 42. The angled side 42 is angled into the laminate 2. The angled side 42 is arranged such that the size of the recess 40 on the inside (i.e. closest to the inner layer 4) is smaller than the size of the recess 40 on the outside (i.e. closer to the outer layer 3). That is, the height of the recess 40 in the plane of the laminate is greater at the outer surface of the outer layer 3 than towards the inner layer 4. The angled side 42 of the recess 40 is diagonal relative to an outer surface of the laminate 2. The angled side 42 is sloped into the recess 40.

The recess 40 of the examples of FIGS. 1 to 6 make it easier for the user to lift and grip the tab 17 to open the cover flap 20. The recess 40 provides additional space adjacent to the distal side of the 17 for a user to insert their finger or thumb to lift the tab 17. In the example of FIG. 6, the angled side 42 of the recess 40 means less material has to be removed to provide the same advantage, which can reduce manufacturing time.

It will be appreciated that the laminate 2 may have more than three layers bonded together in a similar manner to that described above, with the first and second cuts 5, 6 each provided in one or more of the layers.

Each layer may comprise one or more of a polymer, an orientated polymer, a metal foil, for example an aluminium foil, a metallised polymer, or other similar flexible materials for use as packaging.

The layers may be permanently bonded together using a permanent adhesive, that is, an adhesive that strongly bonds the layers together such that the layers do not separate when the wrapper is opened or closed.

The pressure-sensitive adhesive allows layers of the laminate 2 to be reattached to each other after delamination. The pressure sensitive adhesive is a non-drying, permanently tacky adhesive, such that the pressure sensitive adhesive can be used multiple times to detach and reattach the layers of the laminate 2 in the peripheral region 15.

In a preferred example, the laminate 2 comprises three layers, the inner and outer layers 3, 4 being made of polyethylene terephthalate (PET) and the third layer 21, disposed between the inner and outer layers 3, 4, is made of oriented polypropylene (OPP).

In examples, the inner and outer layers 3, 4 have a thickness of between 10 microns and 50 microns.

In one example, the inner and outer layers 3, 4 preferably have a thickness of between 10 microns and 30 microns, more preferably approximately 20 microns. This has been found to provide an adequate seal for preventing ingress of fluids through the first and second cuts 5, 6.

In another example, the inner and outer layers 3, 4 have a thickness of between 30 microns and 50 microns, more preferably approximately 40 microns. This has been found to provide sufficient rigidity in the laminate 2 for repetitive opening and closing, while limiting material usage.

In examples, the oriented polypropylene has a thickness of between 5 microns and 20 microns, preferably between 5 microns and 15 micros, more preferably approximately 9 microns.

The first and second cuts 5, 6 can be formed in the laminate 2 using a mechanical cutter with a limited, predetermined, cutting depth. That is, the mechanical cutter is adapted to cut through the appropriate layers and not the others in the manner previously described. Such a process is known as die cutting or kiss cutting.

Alternatively, the first and second cuts 5, 6 can be formed using lasers. For example, a first laser can be configured to cut the outer layer 3 but not the inner layer 4 and a second laser can be configured to cut the inner layer 4 but not the outer layer 3. Either of the lasers can be configured to also cut the third layer 21. Therefore, the lasers can be configured to cut the layers of the laminate 2 in any of the ways previously described, in particular with reference to FIGS. 4 and 5.

A laser can also be used to ablate the laminate 2 to form the recess 40. The angled side 42 of the recess 40, as described with reference to FIG. 6, may be provided by angling the laser, or by altering the power of the laser as it is scanned across the laminate 2 to form the recess 40.

A first laser, only capable of cutting through PET, forms the first cut 5 in the outer layer 3 from the side of the outer layer 3. The first laser is not capable of cutting through the OPP third layer 21, so the first cut 5 is limited to the outer layer 3. The first laser can also be scanned across the laminate 2 to form the recess 40.

A second laser, capable of cutting through OPP, forms the second cut 6 in the inner layer 4 and third layer 21 from the side of the inner layer 4. When forming the second cut 6 the second laser beam passes through the inner layer 4, is incident on the third layer 21, which cuts the third layer 21, and some of the energy also cuts the inner layer 4. Therefore, the second laser will form a cut in the third layer 21 and inner layer 4.

The first and second lasers can be configured in the above described manner by selecting an appropriate wavelength and power for the material to be cut.

Dust extraction means may be provided to remove ablated material from the first cut 5, second cut 6, and recess 40. The dust extraction means may be a vacuum extractor.

It will be appreciated that other packaging materials are also capable of being cut with lasers, and the above is merely a preferred embodiment. In particular, lasers can be configured with an appropriate wavelength and/or power to cut only through a single layer of polymer and not an adjacent layer. Therefore, laser cutting could also be used to provide the first and second cuts 5, 6 in the two layer laminate 2 described with reference to FIG. 5 or FIG. 6.

The first and second cuts 5, 6 in the laminate 2 may each extend entirely through the relevant layer of the laminate 2. Alternatively, the cuts 5, 6 may extend only partially through the relevant layer of the laminate 2, and the remainder of that layer will tear on pulling the tab region 17 to form the opening. The fibres of an oriented polymer, for example oriented polypropylene, can be orientated in the direction of such a tear to facilitate the tearing action.

The pressure sensitive adhesive on the cover flap 20 is arranged such that, after opening, the pressure sensitive adhesive remains on the outer layer 3 of the laminate 2. That is, the pressure sensitive adhesive is provided to the outer layer 3 before the laminate 2 is formed by applying the inner layer 4 (and any other layers) to form a laminate. Therefore, when the cover flap 20 is reclosed, the outer and inner layers 3, 4 in the peripheral region 15 are readhered to each other by the pressure sensitive adhesive on the outer layer 3.

Figure 7:
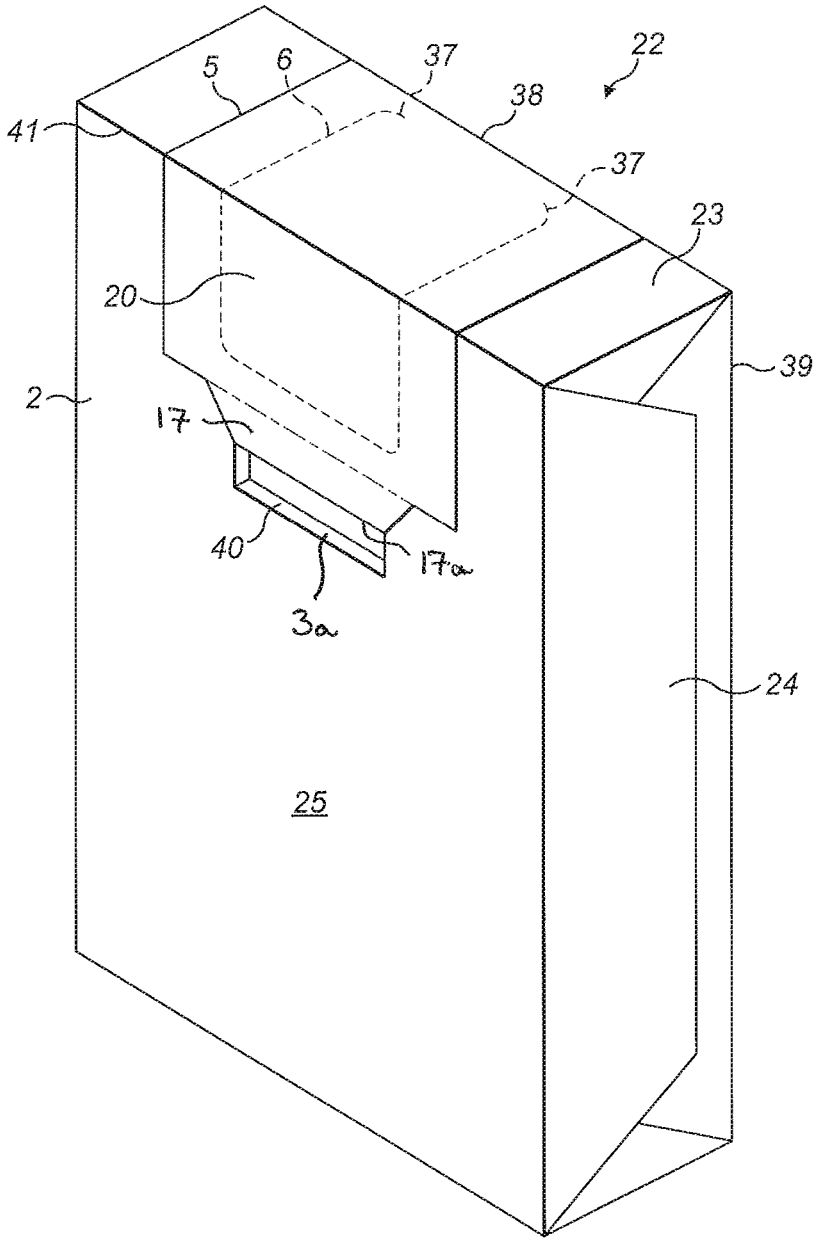
FIG. 7 shows a wrapped bundle of tobacco industry products.

FIG. 7 shows a wrapped bundle 22 containing cigarettes that has been made by wrapping the above described laminate 2 around a group of cigarettes. The cigarettes are elongate cylindrical articles arranged in a collation and then wrapped in the laminate 2. As shown, the laminate 2 has been folded about a group of cigarettes with first and second cuts 5, 6 extending from a front face 25 of the wrapped bundle 22, over a front edge 41, and onto one end face 23 of the wrapped bundle 22. That end face 23 of the wrapped bundle 22 corresponds to the ends of the cigarettes, so that cigarettes can be extracted lengthwise from the wrapped bundle 22 when the opening is formed (19, see FIG. 3). In particular, the end face 23 of the wrapped bundle 22 corresponds to the filter ends of the cigarettes so that the cigarettes can be extracted filter-first.

As shown, the rounded ends 37 of the second cut 6 may be positioned on the end face 23 of wrapped bundle 22, such that the opening 19 does not extend over the rear edge 38.

In another example, the second cut 6 extends over a rear edge 38 of the wrapped bundle 22 and onto the rear face 39 of the wrapped bundle 22, which is opposite to the front face 25. In this way, when the opening (19, see FIG. 3) is formed it extends over the entire end face 23 of the wrapped bundle 22.

It will be appreciated that the opening (19, see FIG. 3) will be formed to the extent of the rounded ends 37 (see FIG. 2) of the second cut 6.

In the example shown in FIG. 7, the ends 24 of the wrapper 1 have been folded against the sides of the group of cigarettes. These folded ends 24 can be sealed, for example using an induction sealing process, a heat sealing process, a fin sealing process or adhesive, to provide a sealed wrapped bundle 22 of cigarettes.

Optionally, an inner frame is provided between the cigarettes and the laminate 2 to provide rigidity to the wrapped bundle 22 and additional protection for the cigarettes.

Figure 8:
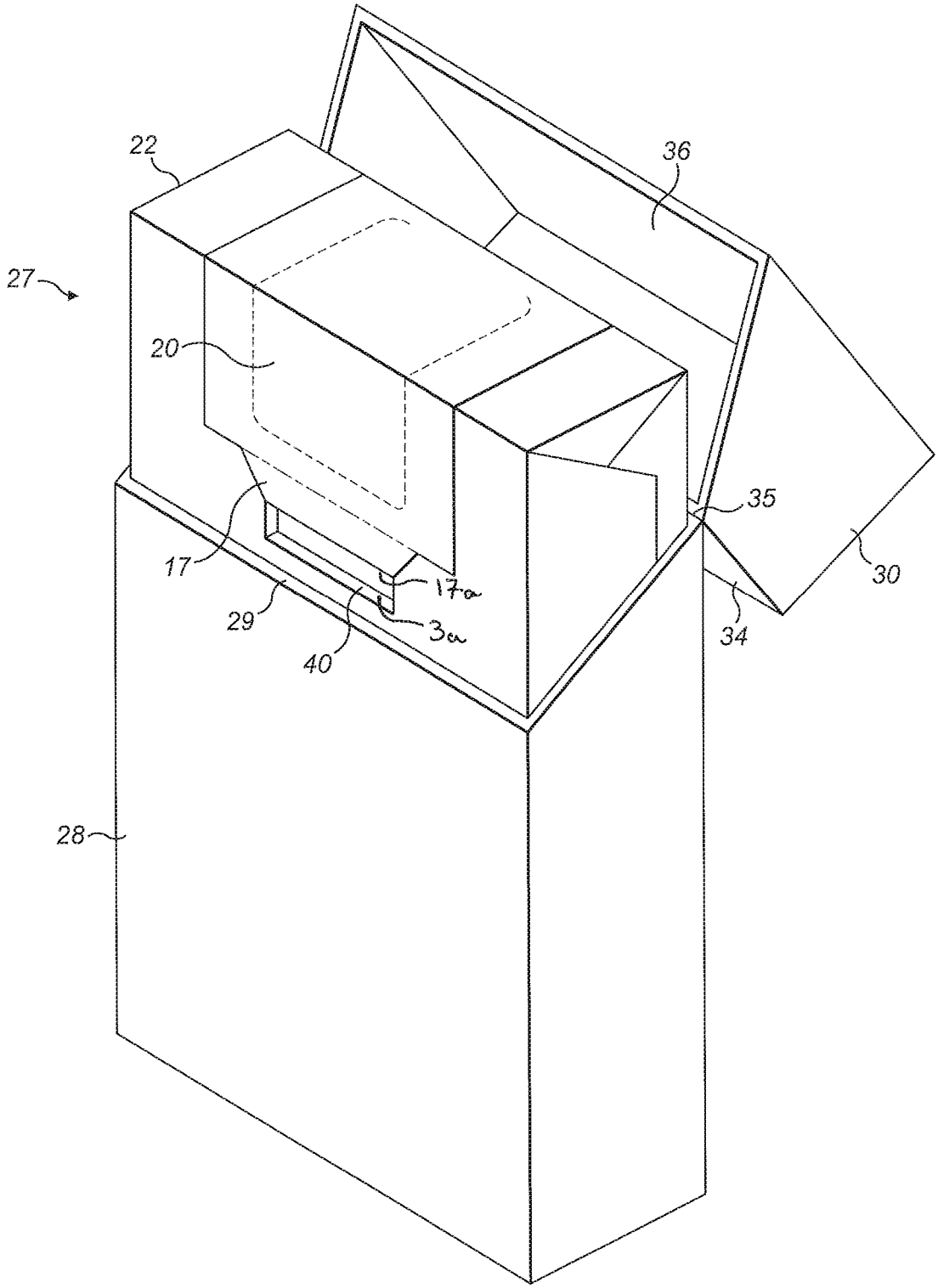
FIG. 8 shows a pack of tobacco industry products containing the wrapped bundle of FIG. 7.

FIG. 8 shows a hinged-lid pack 27 that contains the wrapped bundle 22 of FIG. 7. The hinged-lid pack 27 comprises a base portion 28 in which the wrapped bundle 22 is received such that it protrudes from an open end 29 of the base portion 28. The pack 27 also has a lid 30 hingedly mounted to the base portion 28. In the closed position the lid 30 covers the protruding end of the wrapped bundle 22, and in the open position shown in FIG. 8, the protruding end of the wrapped bundle 22 is exposed and accessible.

The lid 30 comprises a rear wall 34 which is hingedly mounted to the base 28 about a hinge 35. The lid 30 also has a front wall 36, opposite to the rear wall 34. The lid 30 can pivot closed to cover the wrapped bundle 22. As shown, when the lid 30 is open, a user can access the tab 17 of the cover flap 20 to open the wrapped bundle 22. The recess 40 makes it easier for the user to grasp and lift the tab 17.

Figure 9:
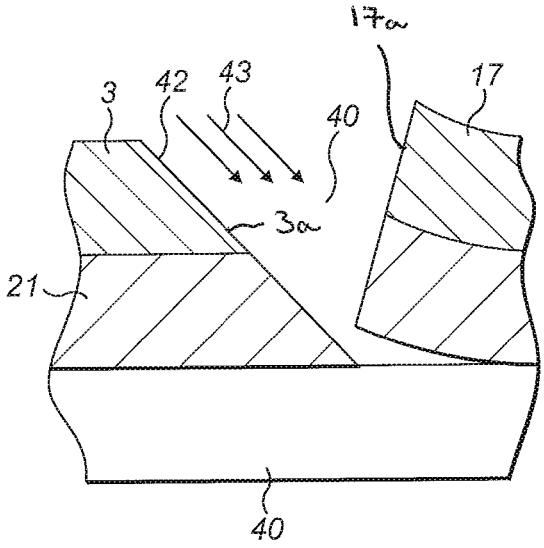
FIG. 9 shows a schematic diagram of lifting a tab of the wrapped bundle of FIG. 7.
Figure 10:
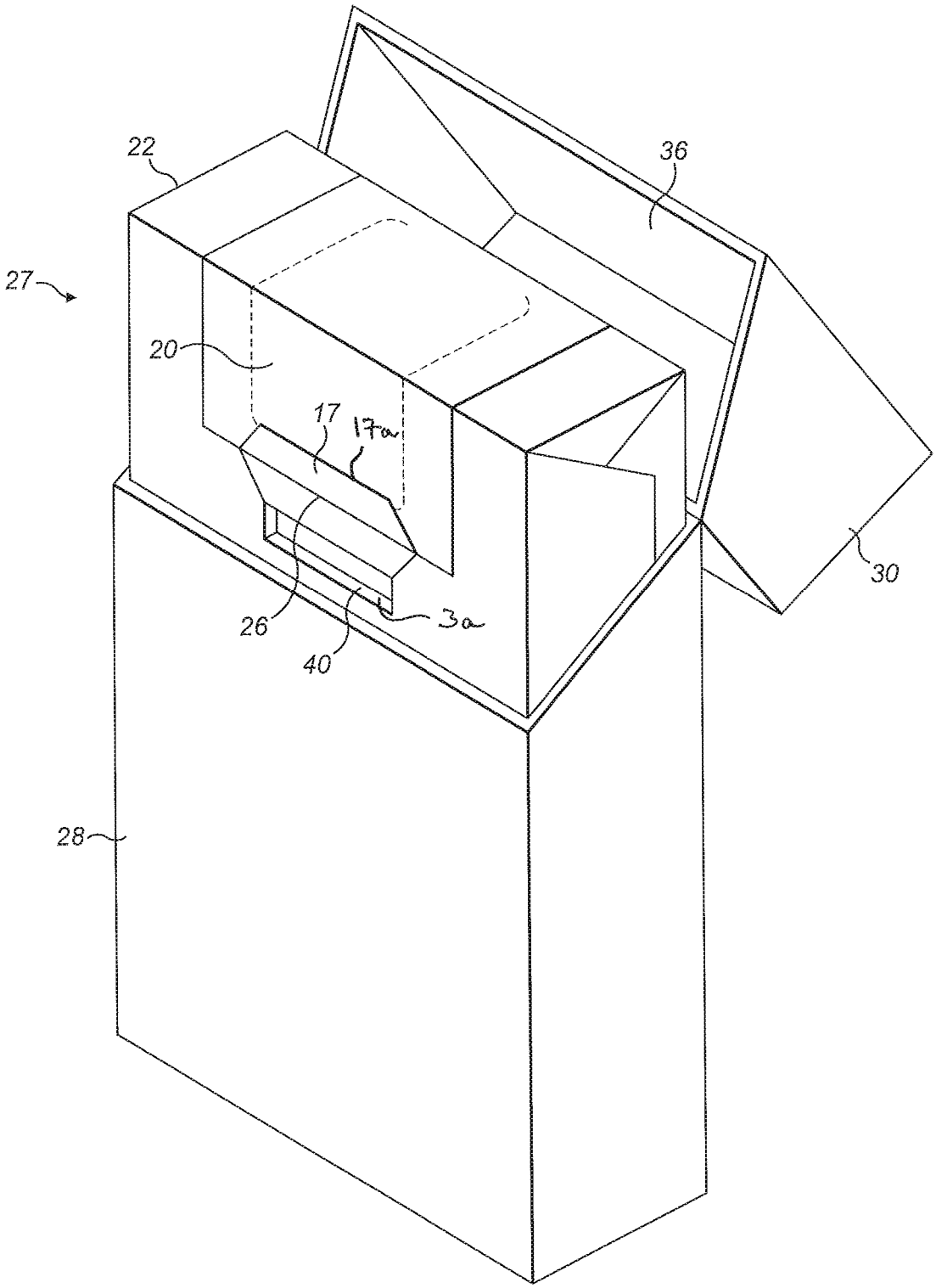
FIG. 10 shows a pack of tobacco industry products containing the wrapped bundle of FIG. 7 after the tab has been lifted; and, FIG. 11 shows a laminate that includes an adhesive-free region.

FIG. 9 shows an enlarged cross-section of an example laminate 2 in the region of the tab 17 and recess 40. As described with reference to FIG. 6, the laminate 2 comprises an outer layer 3, an inner layer 4, and a third layer 21 between the outer layer 3 and the inner layer 4. The recess 40 has an angled side 42. In this example, the tab 17 is lifted and folded back against the cover flap 20 before or during inserting the wrapped bundle 22 into a hinged-lid pack 27, as shown in FIG. 10. FIG. 10 shows the tab 17 in a folded back position, where it lies against the outer layer 3 of the cover flap 20.

As shown in FIG. 9, to achieve this, an air jet 43 may be directed into the recess 40, which directs the air jet 43 underneath the tab 17 in order to lift the tab 17. The air jet 43 can perform an initial lifting and then the tab 17 can be folded back as shown in FIG. 10. Once the wrapped bundle 22 is received in the hinged-lid pack 27, the front wall 36 of the lid 30 holds the tab 17 in the folded position. Preferably, in these examples, the tab 17 includes a fold line 26 as described with reference to FIGS. 1 to 3, to aid folding of the tab 17.

In the above described embodiments the pack 27 may be manufactured by first wrapping the tobacco industry products in the laminate 2 to form a wrapped bundle 22 and then folding the pack base portion 28 and lid 30 around the wrapped bundle 22.

Figure 11:
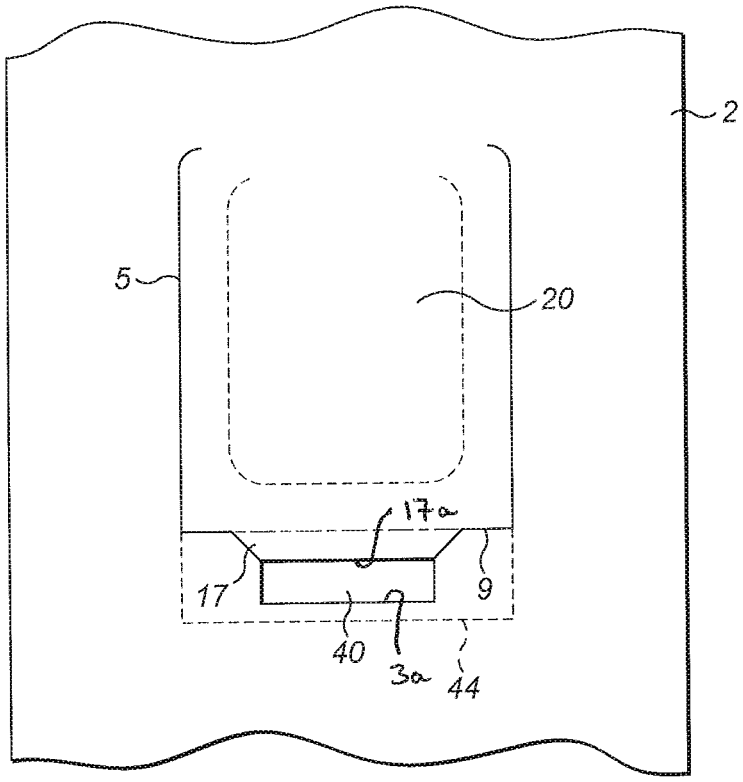

In some examples, illustrated in FIG. 11, the laminate 2 is provided with an adhesive-free area 44. The adhesive free area 44 is aligned with the tab 17, so that there is no adhesive on the tab 17. The adhesive-free area 44 may be aligned with the bottom edge 9 of the first cut 5, extending away from the cover flap 20 over the tab 17 and recess 40.

The adhesive-free area 44 makes it easier to lift the tab 17, and also ensures that the user doesn't get adhesive on their fingers when gripping the tab 17. The adhesive-free area 44 may also cover the recess 40, so that no adhesive is exposed in the recess 40.

The adhesive-free region 44 is provided in the laminate 2 before the layers 3, 4, 21 are laminated together. The adhesive-free region 44 is provided between the layers 3, 4, 21 that separate when the cover flap 20 is opened, as previously described.

In other examples, an area of permanent adhesive may be provided in the second region 12 (see FIG. 2), to ensure that the first and second regions 8, 12 remain attached to each other when the cover flap 20 is opened. Permanent adhesive may also be applied between the layers 3, 4, 21 of the laminate 2 in areas outside of the marginal region 15. It will be appreciated that different adhesives, and different adhesive weights, can be used in different areas of the laminate 2, so long as the user is able to delaminate the laminate 2 in the marginal region 15 and the second region 12 remains attached to the first region 8 so that the opening 19 is formed.

It will be appreciated that the above described examples of packaging may be used to package tobacco industry products other than cigarettes. As used herein, the term "tobacco industry product" is to be understood as including smoking articles comprising combustible smoking articles such as cigarettes, cigarillos, cigars, tobacco for pipes or for roll-your-own cigarettes, (whether based on tobacco, tobacco derivatives, expanded tobacco, reconstituted tobacco, tobacco substitutes or other smokable material), electronic smoking articles such as e-cigarettes, heating devices that release compounds from substrate materials without burning such as tobacco heating products; and hybrid systems to generate aerosol from a combination of substrate materials, for example hybrid systems containing a liquid or gel or solid substrate.

In one embodiment, the tobacco industry product is a smoking article for combustion selected from the group consisting of a cigarette, a cigarillo and a cigar.

In one embodiment, the tobacco industry product is a non-combustible smoking article.

In one embodiment the tobacco industry product is a heating device which releases compounds by heating, but not burning, a substrate material. The material may be for example tobacco or other non-tobacco products, which may or may not contain nicotine. In one embodiment the heating device is a tobacco heating device.

In another embodiment the tobacco industry product is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment the hybrid system comprises a liquid or gel substrate and tobacco.

In order to address various issues and advance the art, the entirety of this disclosure shows by way of illustration various embodiments in which the claimed invention(s) may be practiced and provide for superior packaging for tobacco industry products. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A hinged-lid pack and a group of tobacco industry products wrapped in a laminate to form a wrapped bundle received within the hinged-lid pack, wherein the hinged-lid pack comprises a base portion in which the wrapped bundle is received and a lid hingedly mounted to the base portion, the laminate comprising an outer layer having a first cut that defines an outer layer region bounded by said first cut, and an inner layer having a second cut that defines an inner layer region bounded by said second cut, the inner layer region lying within the outer layer region, wherein the outer layer region comprises a tab engageable by a user after the lid has been rotated into an open position to enable the user to lift the outer layer region to cause the inner and outer layers to delaminate in a peripheral region between the first and second cuts to create an opening in the laminate, wherein the laminate comprises a recess formed in said outer layer and said tab comprises an exposed remote edge that partially bounds the recess such that a user can engage said exposed remote edge of the tab via the recess to lift the outer layer region;

wherein the laminate is not connected to the lid that is hingedly-mounted to the base portion of the hinged-lid pack so that the opening is not created in the pack when the lid is rotated into the open position.

2. The hinged-lid pack and group of tobacco industry products wrapped in a laminate to form a wrapped bundle received within the hinged-lid pack of claim 1, wherein the entire edge of the tab is exposed.

3. The hinged-lid pack and group of tobacco industry products wrapped in a laminate to form a wrapped bundle received within the hinged-lid pack according of claim 1, wherein said recess is additionally partially bounded by an opposing edge of said outer layer that faces the exposed remote edge of the tab, said exposed remote edge of the tab and opposing edge of the outer layer being spaced from each other.

4. The hinged-lid pack and group of tobacco industry products wrapped in a laminate to form a wrapped bundle received within the hinged-lid pack of claim 3, wherein said opposing edge of the outer layer is angled relative to the remote edge of the tab.

5. The hinged-lid pack and group of tobacco industry products wrapped in a laminate to form a wrapped bundle received within the hinged-lid pack of claim 1, wherein the outer layer comprises a line of weakness defining an edge of the tab.

6. The hinged-lid pack and group of tobacco industry products wrapped in a laminate to form a wrapped bundle received within the hinged-lid pack of claim 5, wherein the tab is folded about the line of weakness.

7. The hinged-lid pack and group of tobacco industry products wrapped in a laminate to form a wrapped bundle received within the hinged-lid pack of claim 1, further comprising an adhesive-free region between the outer layer and inner layer of the laminate, the adhesive-free region being coincident with the tab.

8. The hinged-lid pack and group of tobacco industry products wrapped in a laminate to form a wrapped bundle received within the hinged-lid pack of claim 7, wherein the adhesive-free region covers the recess.

9. The hinged-lid pack and group of tobacco industry products wrapped in a laminate to form a wrapped bundle received within the hinged-lid pack of claim 1, wherein at least the peripheral region of the laminate comprises a pressure-sensitive adhesive between the inner layer and the outer layer such that the outer layer can be re-adhered to the inner layer in the peripheral region.

10. The hinged-lid pack and group of tobacco industry products wrapped in a laminate to form a wrapped bundle received within the hinged-lid pack of claim 1, wherein the inner layer region and the outer layer region are attached to each other using a permanent adhesive.

11. The hinged-lid pack and group of tobacco industry products wrapped in a laminate to form a wrapped bundle received within the hinged-lid pack of claim 1, wherein the laminate comprises a third layer, disposed between the inner layer and the outer layer, and wherein either the first cut or the second cut extends through the third layer.

12. The hinged-lid pack and group of tobacco industry products wrapped in a laminate to form a wrapped bundle received within the hinged-lid pack of claim 11, wherein the first cut extends through the third layer, and wherein the recess extends through the first layer and at least partially through the third layer.

13. The hinged-lid pack and group of tobacco industry products wrapped in a laminate to form a wrapped bundle received within the hinged-lid pack of claim 12, wherein the recess extends entirely through the third layer.

14. The hinged-lid pack and group of tobacco industry products wrapped in a laminate to form a wrapped bundle received within the hinged-lid pack of claim 1, wherein the inner layer and/or the outer layer comprise polyethylene terephthalate.

15. The hinged-lid pack and group of tobacco industry products wrapped in a laminate to form a wrapped bundle received within the hinged-lid pack according of claim 1, wherein the first cut and the second cut are formed by laser cutting.

16. The hinged-lid pack and group of tobacco industry products wrapped in a laminate to form a wrapped bundle received within the hinged-lid pack of claim 1, wherein the recess is formed by laser ablation.

17. The hinged-lid pack and group of tobacco industry products wrapped in a laminate to form a wrapped bundle received within the hinged-lid pack of claim 3, wherein said opposing edge of the outer layer and the remote edge of the tab are parallel.

18. The hinged-lid pack and group of tobacco industry products wrapped in a laminate to form a wrapped bundle received within the hinged-lid pack according of claim 1, wherein the recess extends through the entire thickness of the outer layer.

19. The hinged-lid pack and group of tobacco industry products wrapped in a laminate to form a wrapped bundle received within the hinged-lid pack according of claim 1, wherein the recess extends only partially through the thickness of the outer layer.

* * * * *